US011673636B1

(12) United States Patent
Goetz et al.

(10) Patent No.: US 11,673,636 B1
(45) Date of Patent: Jun. 13, 2023

(54) UNMANNED UNDERWATER VEHICLE HAVING MONOCOQUE BODY

(71) Applicant: Composite Energy Technologies, Inc., Bristol, RI (US)

(72) Inventors: Eric P. Goetz, Bristol, RI (US); Thomas John Perrotti, Bristol, RI (US); Sabrina Marie Kanaley, Bristol, RI (US)

(73) Assignee: Composite Energy Technologies, Inc., Bristol, RI (US)

( * ) Notice: Subject to any disclaimer, the term of this patent is extended or adjusted under 35 U.S.C. 154(b) by 0 days.

(21) Appl. No.: 17/589,055

(22) Filed: Jan. 31, 2022

(51) Int. Cl.

| | |
|---|---|
| ***B63G 8/00*** | (2006.01) |
| ***B63G 8/22*** | (2006.01) |
| ***B63B 3/13*** | (2006.01) |
| *B63B 5/24* | (2006.01) |

(52) U.S. Cl.
CPC ..... *B63G 8/001* (2013.01); *B63B 3/13* (2013.01); *B63G 8/22* (2013.01); *B63B 5/24* (2013.01); *B63G 2008/002* (2013.01)

(58) Field of Classification Search
CPC . B63G 8/00; B63G 8/001; B63G 8/22; B63G 2008/002; B63B 3/00; B63B 3/13; B63B 5/00; B63B 5/24
USPC ..... 114/357, 312
See application file for complete search history.

(56) References Cited

U.S. PATENT DOCUMENTS

| | | | | |
|---|---|---|---|---|
| 4,992,999 | A * | 2/1991 | Yerby | B63G 8/001 367/106 |
| 5,995,882 | A | 11/1999 | Patterson et al. | |
| 6,640,739 | B2 | 11/2003 | Woodall et al. | |
| 6,807,921 | B2 | 10/2004 | Huntsman | |
| 7,290,496 | B2 | 11/2007 | Asfar et al. | |
| 9,096,106 | B2 | 8/2015 | Hanson et al. | |
| 9,630,686 | B2 * | 4/2017 | Morash | B63G 8/001 |
| 9,776,693 | B2 * | 10/2017 | Rikoski | B63G 8/001 |
| 9,849,953 | B2 * | 12/2017 | Brizard | B63G 8/001 |
| 10,000,260 | B2 * | 6/2018 | Morash | B63G 8/001 |
| 10,000,263 | B2 | 6/2018 | Farber et al. | |
| 10,322,783 | B2 | 6/2019 | Valsvik et al. | |
| 2014/0165898 | A1 | 6/2014 | Cierpka et al. | |
| 2021/0371067 | A1 * | 12/2021 | Lebo | B63G 8/001 |

FOREIGN PATENT DOCUMENTS

| | | | |
|---|---|---|---|
| CN | 108622343 | A | 10/2018 |
| CN | 208007255 | U | 10/2018 |
| CN | 208198791 | U | 12/2018 |
| CN | 111268069 | A | 6/2020 |

OTHER PUBLICATIONS

Neira, J. et al., "Review on Unmanned Underwater Robotics, Structure Designs, Materials, Sensors, Actuators, and Navigation Control", Journal of Robotics, vol. 2021, Article ID 5542920 (2021) 26 pages.

Trembanis, A. et al., "Autonomous Underwater Vehicle", ScienceDirect, (2021) 15 pages.

* cited by examiner

*Primary Examiner* — Lars A Olson
(74) *Attorney, Agent, or Firm* — Fox Rothschild LLP

(57) ABSTRACT

The present disclosure generally relates to a monocoque body for an unmanned underwater vehicle ("UUV") comprising a nose portion, a tail portion, a body interior surface, a body exterior surface. The monocoque body can be a one-piece structural shell made of fiber reinforced polymer. The UUV may further include transverse structural members.

19 Claims, 9 Drawing Sheets

FIG. 3C (back cross section)

UNMANNED UNDERWATER VEHICLE HAVING MONOCOQUE BODY

FIELD

The present disclosure generally relates to unmanned underwater or submersible vehicles.

BACKGROUND

Unmanned underwater vehicle ("UUV") have many useful applications in a variety of industries to explore underwater areas, collect data, conduct inspections, monitor specific underwater zones, etc. For example, UUV's can be used to conduct underwater explorations for mining or oil drilling, inspect underwater cables, monitor areas for national defense purposes, and collect data in previously unexplored areas, all without the need for a human driver present on the vehicle. Known UUVs have deficiencies or can be benefit from improvements to their performance. For example, conventional UUV's may not be suitable for deep underwater missions that can cause UUV's to experience high pressures and other adverse conditions. Such missions can require a strong but light UUV. Conventional heavy UUV's can be limited in the amount of payload they can carry, which may limit the types and lengths of missions that they can conduct. It is therefore desirable to have a stronger and lighter UUV capable of handling more payload to extend the range of the UUV, conduct deep underwater missions, and obtain other advantages.

SUMMARY

In one aspect, the disclosed technology relates to a monocoque body for an unmanned underwater vehicle ("UUV") including a nose portion, a tail portion, a body interior surface, and a body exterior surface. The monocoque body may be a one-piece structural shell made of fiber reinforced sheet.

In some embodiments, the fiber reinforced sheet can be a polymer reinforced by carbon fiber. The monocoque body can form a portion of a UUV that is free-flooding. The monocoque body may further include an acoustically transparent window. The acoustically transparent window can be integrally formed out of the fiber reinforced sheet and is configured to permit acoustic signals to travel through the monocoque body.

The body interior surface may form a cavity and the monocoque body may further include a plurality of transverse structural members integrally formed into monocoque body. The transverse structural members may separate the cavity into a plurality of payload area(s) that can be configured to receive a payload for attachment to the monocoque body. The payload can be at least one of: a battery, a motor, a pressure vessel, or a sensor. The monocoque body can further include one or more longitudinal supports extending axially along the underbody between the tail portion and the nose portion. The longitudinal supports can form an attachment rail. The attachment rail can be configured to receive a payload. The monocoque body can further include an aperture extending through the body exterior surface, the aperture being configured to receive a face of a sensor connected to the monocoque body.

In another aspect, disclosed embodiments provide an unmanned underwater vehicle ("UUV") including a monocoque underbody providing structural support for the UUV and adapted to receive a payload, the monocoque underbody comprising: a nose portion, a tail portion, a body interior surface forming a cavity, a body exterior surface, and a plurality of transverse structural members integrally formed into underbody. The underbody can be constructed of a polymer reinforced by carbon fiber. The UUV can be free-flooding. The UUV can further include a cover extending from the nose portion to the tail portion. The cover can include a cover interior surface; and a cover exterior surface. The cover can attach to the underbody such that the cover interior surface faces the body interior surface, and the cover exterior surface and the body exterior surface together form an exterior surface of the UUV. The cover may be removably attached to permit access to the cavity.

In some embodiments, the body exterior surface may form 30% to 70% of a total exterior surface of the UUV. The underbody can be constructed of a first material and the cover can be constructed of a second material. The second material can have a relatively lower material strength or weight than that of the first material. The underbody can further include one or more longitudinal supports extending axially along the underbody between the tail portion and the nose portion and forming an attachment rail(s).

In another aspect, disclosed embodiments provide an unmanned underwater vehicle ("UUV") comprising a monocoque underbody that preferably spans from nose to tail of the UUV and can be made of fiber reinforced multilayer epoxy bound sheet wherein the sheet is adapted (a) to provide a shape of an exterior hydrodynamic shell of the UUV and (b) be the UUV payload support frame that carries desired payloads in the UUV during operation; and is adapted to receive a top removeable UUV cover adapted to be positioned over the underbody.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

FIG. 3C is a back sectional view of an exemplary unmanned underwater vehicle, in accordance with one or more embodiments of the present invention(s).

DETAILED DESCRIPTION

Figure 1:
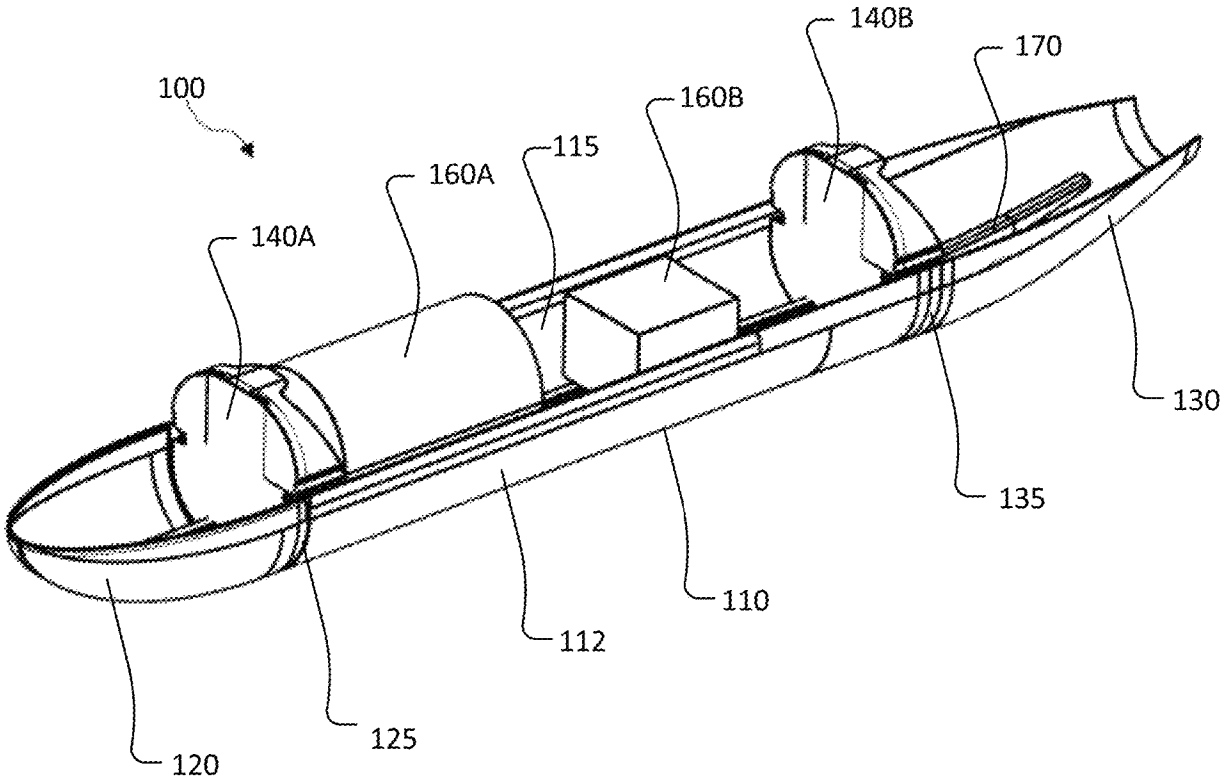
FIG. 1 is a perspective view of an exemplary unmanned underwater vehicle, in accordance with one or more embodiments of the present invention(s).

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

The devices of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, proximal, distal, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior". The words "can" or "may" are used to communicate that this is one embodiment but others are contemplated.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

The present disclosure relates to an unmanned underwater vehicle ("UUV") having a monocoque hull construction. UUV's have many useful applications in a variety of industries to explore underwater areas, collect data, conduct inspections, monitor specific underwater zones, etc. For example, UUV's can be used to conduct underwater explorations for mining or oil drilling, inspect underwater cables, monitor areas for national defense purposes, and collect data in previously unexplored areas, all without the need for a human driver present on the vehicle. Deep underwater missions (for example, missions conducted at or below about 1,500 meters below sea level, at or below about 4,000 meters below sea level, or at or below about 6,000 meters below sea level) can cause UUV's to experience high pressures and other adverse conditions requiring a strong but light UUV. As used herein, a monocoque refers to a structural shell or exoskeleton in which the vehicle's structural frame and outer hull are built as an integrated structure.

Accordingly, the UUV can have a monocoque body or canoe-shaped body that forms an integral shell and support structure for the UUV. An interior area of the monocoque body can house transverse structural members, pressure vessels, and other payloads (e.g., sensors, navigation equipment, propulsion equipment, etc.). In some embodiments, the UUV cover may include a cover that forms a portion of the outer shell of the UUV. The cover may be a fairing that improves the hydrodynamics of the UUV without providing any significant structural support.

Conventional UUV designs typically include metal rings welded together to form the hull of the UUV and a separate internal support structure (such as a welded metal skeleton). Such designs are very heavy and dense, thus presenting limitations with size, depth, speed, range, and payload carrying capacity. The disclosed technology implementing a monocoque body addresses these and other problems by providing a lighter and stronger UUV. Thus, the monocoque body can facilitate relative increases in payload capacity, depth, range, etc. Disclosed embodiments include a monocoque underbody or canoe-shaped design, with a non-structural cover (fairing). Such a design not only significantly decreases the overall weight of the UUV, but also keeps the center of gravity of the UUV lower on the vehicle, which aids with keeping the vehicle upright and avoiding rolling when the UUV is in the water. In some embodiments, the construction of the underbody is adapted to be heavier at the bottom and it may gradually increase following the shape of the underbody. This structure (e.g., without the payload) can be configured to have a center of gravity that is below the centerline of the underbody. For example, by varying the thickness or the material of the monocoque body and positioning certain structural members, the center of gravity is moved lower. In some embodiments, for example, embodiments that include a cover, the structure of the underbody can be configured such that the center of gravity of the UUV (including the cover) is below the centerline of the UUV.

Additionally, such a design permits increased ease of access into the UUV and facilitates modularity of accessories and payload within the UUV. For example, by having a lightweight, easy to remove cover, users can easily access all or nearly all of the UUV payload easily from the top of the UUV. The user does not need to access the interior of the UUV through a small hatch or through one end of the UUV. Thus, disclosed embodiments facilitate easy reconfiguration of the UUV (e.g., changing out batteries, sensors, cameras, weights, or other equipment) so that it can be adapted for different missions or use cases.

FIGS. 1, 2A-2B, and 3A-3D illustrate various views of a UUV 100 with an open top (and no cover). The UUV has a monocoque body 110. The monocoque body 110 can have a nose portion 120 and a tail portion 130. Nose portion 120 and tail portion 130 can be integral to monocoque body 110 (i.e., monocoque body 110 can be a single piece including nose portion 120 and tail portion 130). Monocoque body can also include a body exterior surface 112 and a body interior surface 115, both of which can include a corresponding of area of nose portion 120 and tail portion 130. Body interior surface 112 can form a payload receiving area in the hull of the UUV.

Monocoque body 110 can be constructed as a one-piece structural shell. The structural shell can be an outside hydrodynamic shell forming the exterior of UUV 100. A fiber reinforced polymer bound sheet material (for example, a polymer epoxy reinforced by carbon fiber) may be used for monocoque body 110. As used herein, fiber reinforced polymer bound sheet material may refer to a cured structural epoxy and fiber matrix. Monocoque body 110 may be constructed by layering fiber reinforced polymer and forming it into the hull body shape. Various materials use for construction of monocoque body 110 can include various relative strengths and relative weights. In some embodiments, multiple materials may be combined into a single laminate to achieve a desired strength to weight ratio.

While UUV 100 is depicted in the figures as having certain proportions, other shapes and proportions are possible. For example, UUV 100 may be relatively longer or shorter as compared to its current width. As another example, the tapered portions of nose portion 120 and tail portion 130 may be longer (creating a narrower nose portion 120 and tail portion 130) or shorter (creating a more blunt nose portion 120 or tail portion 130).

Figure 2A:
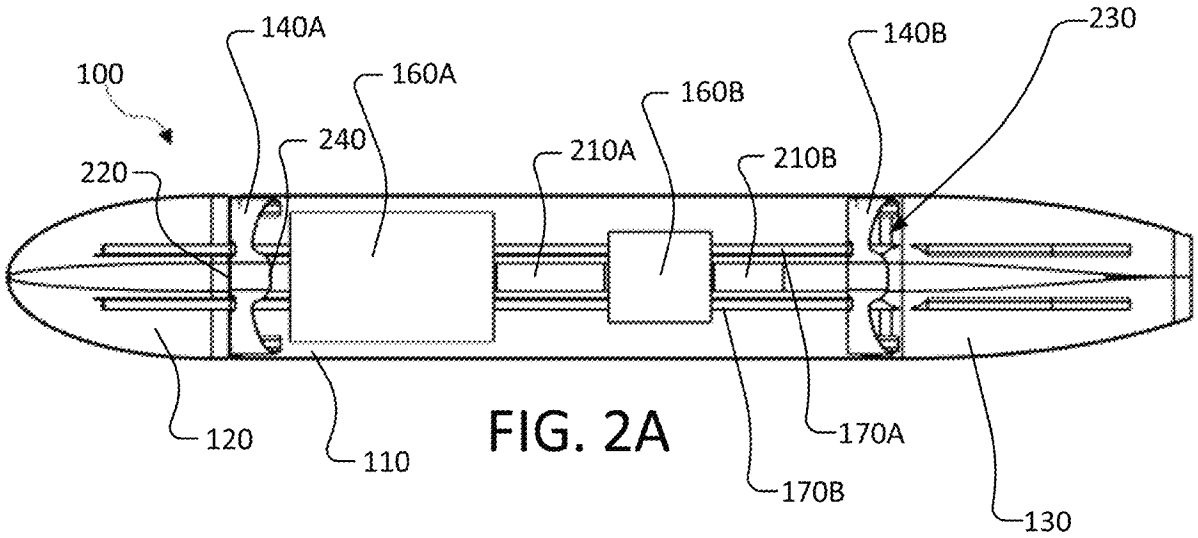
FIG. 2A is a top view of an exemplary unmanned underwater vehicle, in accordance with one or more embodiments of the present invention(s).
Figure 2B:
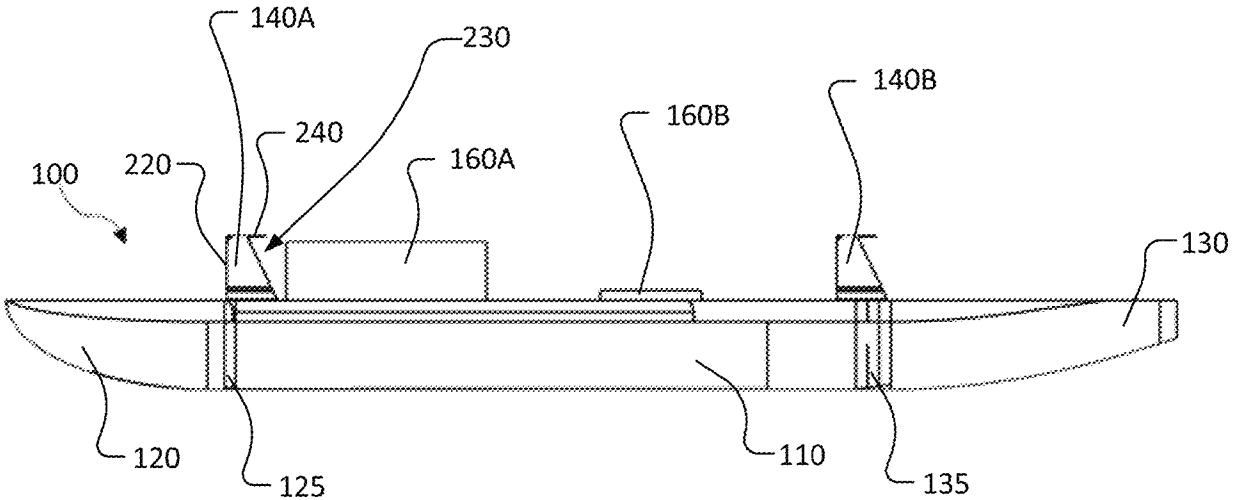
FIG. 2B is a side view of an exemplary unmanned underwater vehicle, in accordance with one or more embodiments of the present invention(s).

UUV 100 can also include one or more longitudinal supports 170. Longitudinal supports 170 can run the length of UUV 100 (i.e., from nose portion 120 to tail portion 130). In some embodiments, longitudinal supports 170 may not run the length of the UUV, but may run along a portion of monocoque body 110 between nose portion 120 and tail portion 130. For example, as shown in FIG. 2A, UUV 100 may include two longitudinal supports 170A and 170B. Longitudinal support 170 can form an attachment rail to which payload can be secured. For example, longitudinal supports 170 may be an L-shaped or T-shaped design with the flat side facing upwards to provide an area for payload to sit and be attached to with fasteners, clamps, welds, adhesives, or suitable securing methods. Longitudinal supports 170 can be integrally formed into monocoque body 110.

UUV 100 can include transverse structural members 140A, 140B. While the figures illustrate two transverse structural members 140A, 140B, more or fewer transverse structural members may be used in UUV 100. In some embodiments, transverse structural members 140A, 140B may be formed as separate pieces from monocoque body 110 and attached to longitudinal supports 170. For example, transverse structural members 140A, 140B may include cutouts or grooves at the bottom to receive a corresponding portion of longitudinal supports 170. Attachment of transverse structural members 140A, 140B may be removeable (e.g., with clamps or fasteners such as screws, bolts, pins, rivets, various suitable adhesives etc.) or permanent (i.e., bonded to the material of monocoque body 110. Transverse structural members 140A, 140B may be made from the same material type as monocoque body 110. In some embodiments, transverse structural members 140A, 140B may be integral to monocoque body 110. In other words, transverse structural members 140A, 140B may be formed with monocoque body 110 out of the same contiguous material, instead of being separately formed and then attached to monocoque body 110). Transverse structural members 140A, 140B can provide additional stiffening to UUV 100. In some embodiments, transverse structural members 140A, 140B may provide additional support for a cover placed on UUV 100 (e.g., as depicted in FIGS. 5-8). Transverse structural members may also separate the interior of the hull of UUV 100 into multiple sections or payload areas.

Additionally, in certain embodiments, transverse structural members 140A, 140B may serve as mounting points for equipment (payload) placed within UUV 100. transverse structural members 140A, 140B can be a variety of shapes and forms. Transverse structural members 140A, 140B may be shaped to fit around certain payloads to provide additional security to the payload while in UUV 100.

UUV 100 may also include one or more payloads 160A, 160B. Payloads 160A, 160B may be encased (e.g., to protect against water intrusion, such as when the UUV is a free-flooding UUV) and can include navigation equipment (GPS, sonar, radar, etc.), sensors (pressure sensors, light sensors, etc.), propulsion equipment (motors, jets, propellors, ballast tanks, etc.), power equipment (batteries, fuel cells, wires, etc.), communications equipment (transmitters, receivers, transceivers, etc.), weights, flotation foam, cameras, lights, data storage equipment, and other equipment. Payloads 160A, 160B may be attached to attachment rails formed by longitudinal supports 170. While depicted in the figures as a generally rectangular box, payloads 160A, 160B can take a variety of shapes and forms (e.g., cubic, generally spherical, conical, cylindrical, or others).

As depicted in FIG. 1, UUV 100 can be an open top free-flooding design, meaning that water can freely flow around, for example, between payloads 160A, 160B. Monocoque body 110 provides structural support for UUV 100 and secures dividers, sensors, communication devices, propulsion systems, and other payloads to the UUV 100.

Dividers 140A, 140B, and payload 160A, 160B can be secured to attachment rails 170.

Figure 3A:
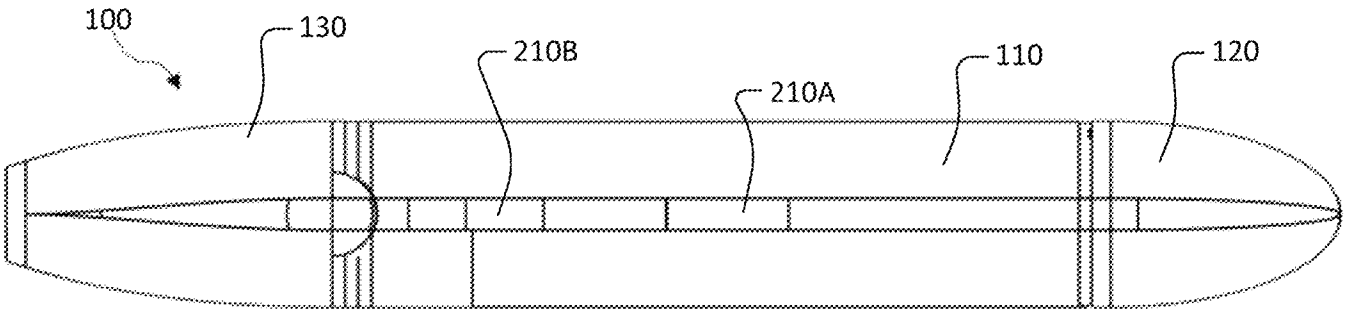
FIG. 3A is a bottom view of an exemplary unmanned underwater vehicle, in accordance with one or more embodiments of the present invention(s).
Figure 3B:
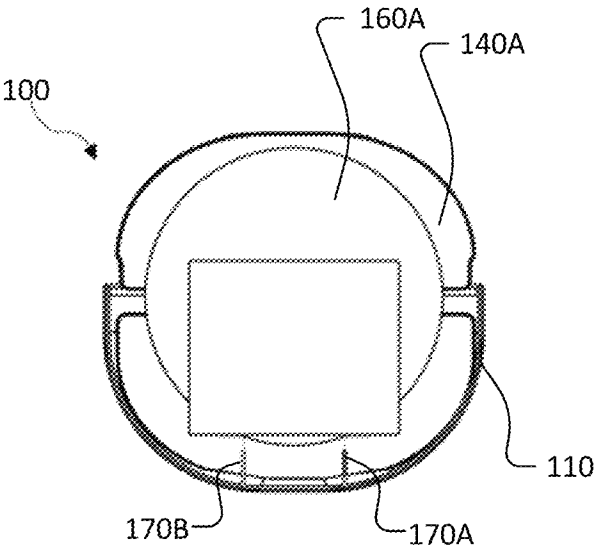
FIG. 3B is a front view of an exemplary unmanned underwater vehicle, in accordance with one or more embodiments of the present invention(s).
Figure 3B:
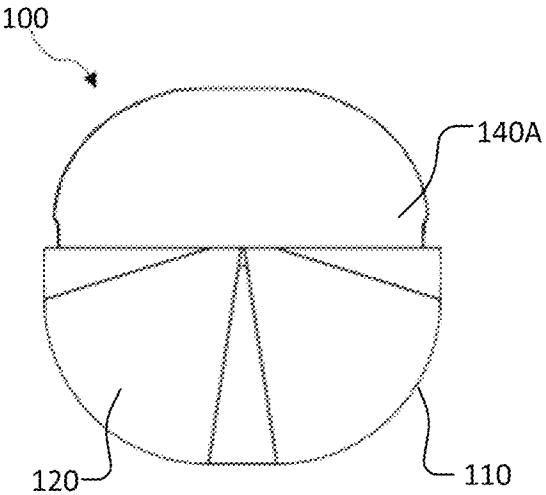

In some embodiments, as shown in FIG. 3A, the bottom of monocoque body 110 may include one or more windows 210A, 210B. Windows 210A, 210B can be open apertures through the surface of monocoque body 110. Windows 210A, 210B can provide areas for various payloads to interface with the exterior of UUV 100. For example, a camera contained with a payload may need a lens with access to the outer surface of UUV 100 in order to capture photographs. Window 210A could be sized and shaped specifically for the camera lens, which could be mounted inside UUV 100, but facing out through monocoque body 110 and forming a water-tight seal with monocoque body 110. As another example, a sonar system could have an external surface mounted in window 210B, which could be appropriately sized to receive the external surface. The external surface of the sonar system could be mounted flush with body exterior surface 115 of monocoque body 110.

In some embodiments, monocoque body 110 may include one or more acoustically transparent windows. An acoustically transparent window may be a portion of monocoque body 110 that permits acoustic signals (i.e., sound waves from sonar) to pass through. Thus, UUV 100 can send and/or receive acoustic signals through monocoque body 110 without the need for a hole being cut or otherwise formed in monocoque body 110 to expose a portion of the sonar device. Such acoustically transparent windows can permit a sonar device to be fully encased within UUV 100 (and thus completely protected from water and other external elements), while still functioning properly. Additionally, by have an acoustically transparent window, monocoque body 110 need not contain a separate cutout window (i.e., windows 210A, 210B) for the sonar system, thereby increasing the structural integrity of UUV 100.

Acoustically transparent windows can be formed through specific construction of the laminate making up monocoque body 110. For example, the types and combinations of resins, fibers, plastics, adhesives, etc. can change the density of the laminate material, and thus affect how acoustic signals are transmitted through the material. The laminate structure of monocoque body 110 can be constructed such that the density of the material making up monocoque body 110 is close to that of water (which varies with temperature). Thus, the material may be constructed to have a specific gravity of about 1. Accordingly, the density of the material may be less than or about 2.0 slugs/ft$^3$. By constructing the material of monocoque body 110 to have a density close to water, the acoustic signals can travel through the material in approximately the same manner as they travel through water (the intended medium for which the waves are travel). Because the density of water varies slightly with temperature, in some embodiments, a monocoque body 110 could be tuned or constructed to be acoustically transparent in a certain temperature of water (e.g., to ensure proper function at a specific geographic location or specific depth under water). Furthermore, acoustically transparent windows may be tuned for various specific wavelengths or frequencies of sound waves.

Thus, an acoustically transparent window could prevent the need for a full cutout 210A, 210B, while still permitting the sonar system to function properly. This can potentially eliminate leakage around cutouts and equipment, protect equipment from unwanted contact with environmental objects by providing a surface of the monocoque body over the equipment, providing a more streamlined UUV, and increasing the structural integrity of the body of the UUV by limiting the number of weaking fully cutout sections.

In some embodiments, monocoque body 110 may include cable ports (not illustrated) for power cables, data cables, etc. Cable ports may be open apertures into monocoque body 110, through transverse structural members 140A, 140B, or through longitudinal supports 170. In some embodiments, monocoque body 110 may include small voids or channels with the thickness of the side walls of monocoque body 110 in which cables may be run. Such voids or channels may permit cables to run between payloads within monocoque body 110 with minimal exposure to the interior of UUV 100. Each end of the void or channel can include a cable port for access to the voids or channels so that cables can be placed inside. Cable ports can include covers or grommets to seal off when not in use or while a cable is run through the port. In some embodiments cable ports may include covered or sealed plug receivers. The plug receivers may be constructed such that a cable can be plugged into one or both sides of the port, thus eliminating the need to physically run the cable through the port. This can not only ensure that payload 160A, 160B is sealed properly from water intrusion, but can also facilitate easy and quick reconfiguration of UUV 100. For example, in some cases, rather than rewiring a piece of equipment or running a new cable through one or more portions of UUV 100, a user may be able to unplug a short length of cable and plug in a new cable to change out a payload. When not in use, a user could place a watertight cover over the port to ensure that water does not enter the port.

Figure 4:
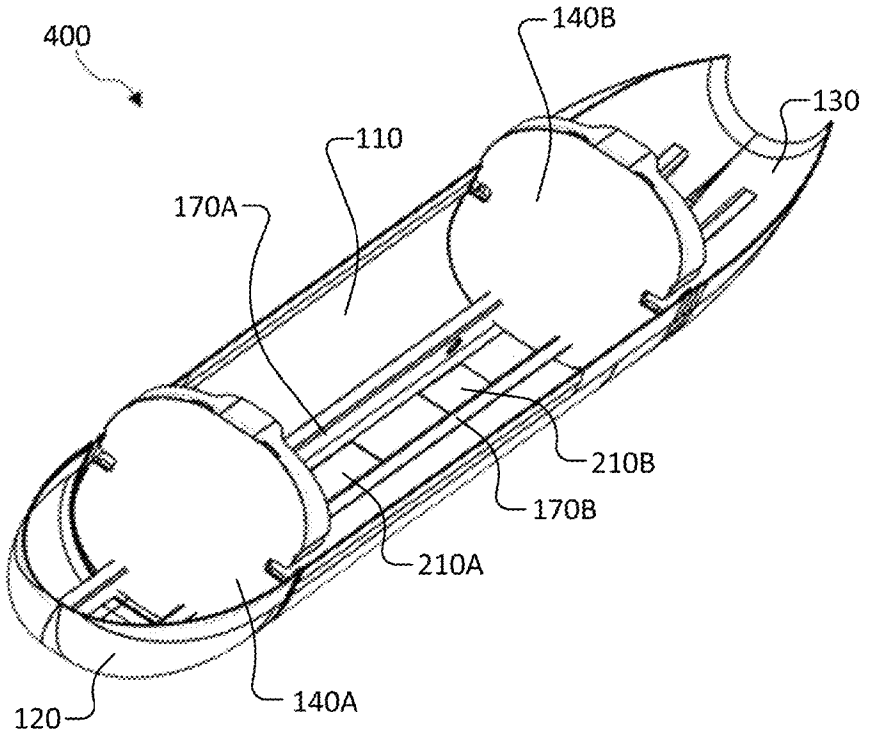
FIG. 4 is a perspective view of an exemplary unmanned underwater vehicle, in accordance with one or more embodiments of the present invention(s).
Figure 5:
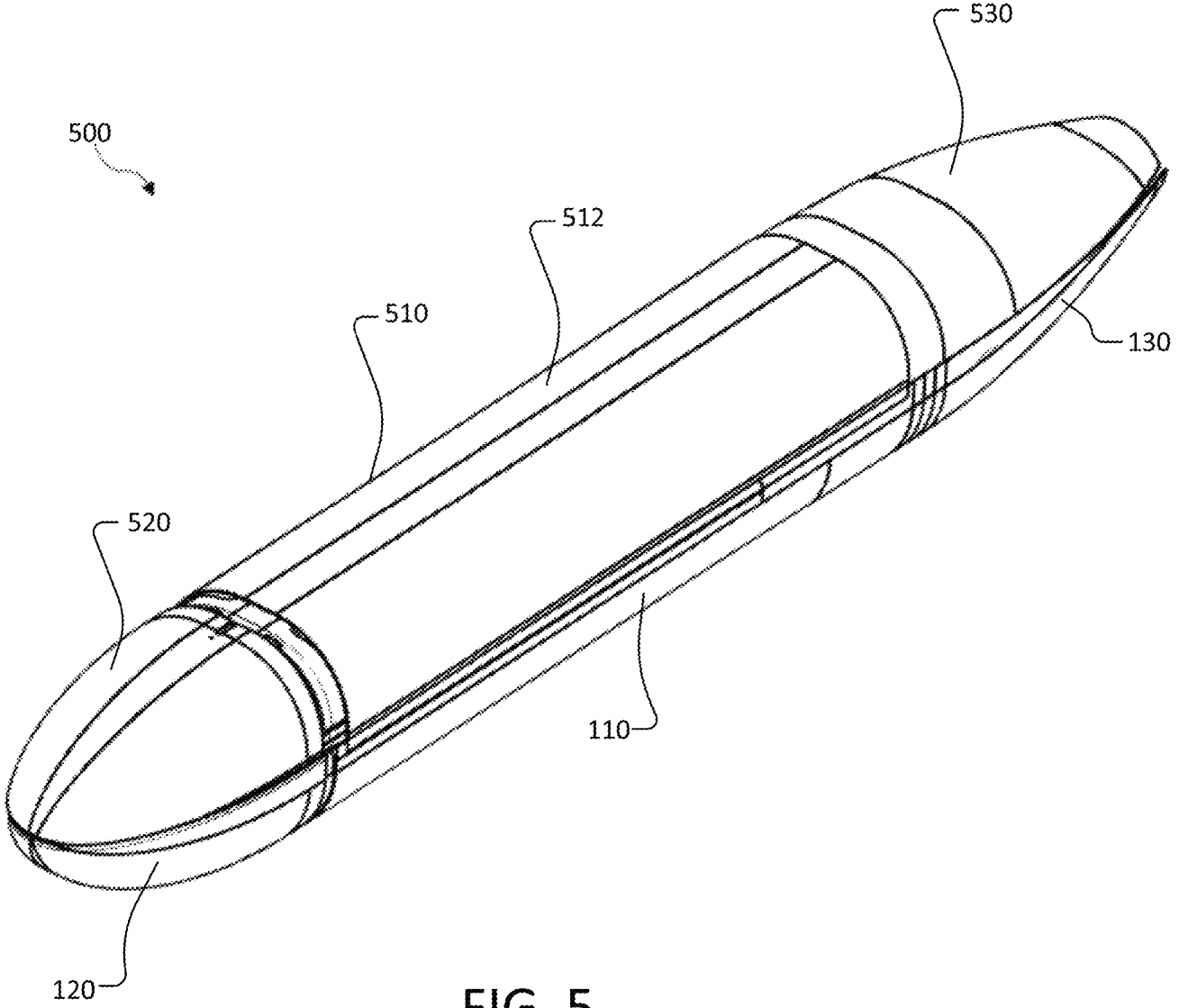
FIG. 5 is a perspective view of an unmanned underwater vehicle with a cover, in accordance with one or more embodiments of the present invention(s).

FIG. 4 provides an alternate perspective view of a UUV 400 that does not contain an extra payload for illustrative purposes. Rather, UUV 400 shows transverse structural members 140A, 140B on the interior of monocoque body 110. The description above with respect to UUV 100 generally applies to UUV 400 as well. FIG. 4 also provides an additional view of longitudinal supports 170A, 170B running along the length of monocoque body 110 (i.e., from at or near the end of nose portion 120 to at or near the end of tail portion 130). As described herein, transverse structural members 140A, 140B may be attached to longitudinal supports 170A, 170B. FIG. 4 additionally illustrates cutouts 210A, 210B. As shown, cutouts 210A, 210B can be placed between longitudinal supports 170A, 170B.

Figure 6B:
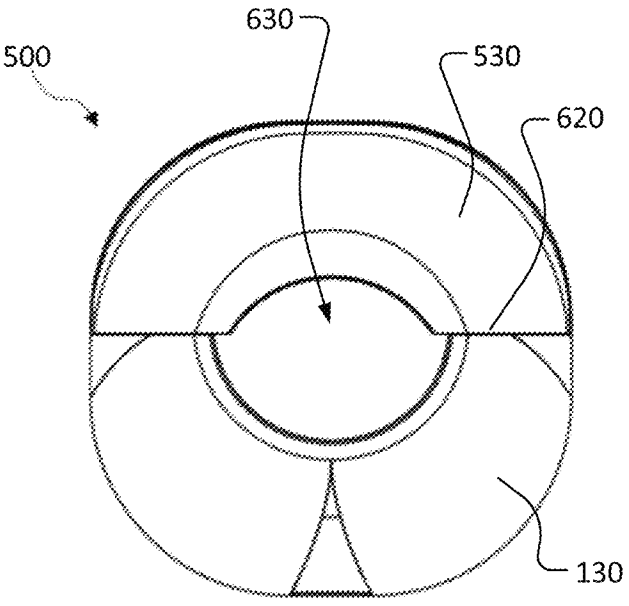
FIG. 6B is a back view of an exemplary unmanned underwater vehicle with a cover, in accordance with one or more embodiments of the present invention(s).
Figure 7A:
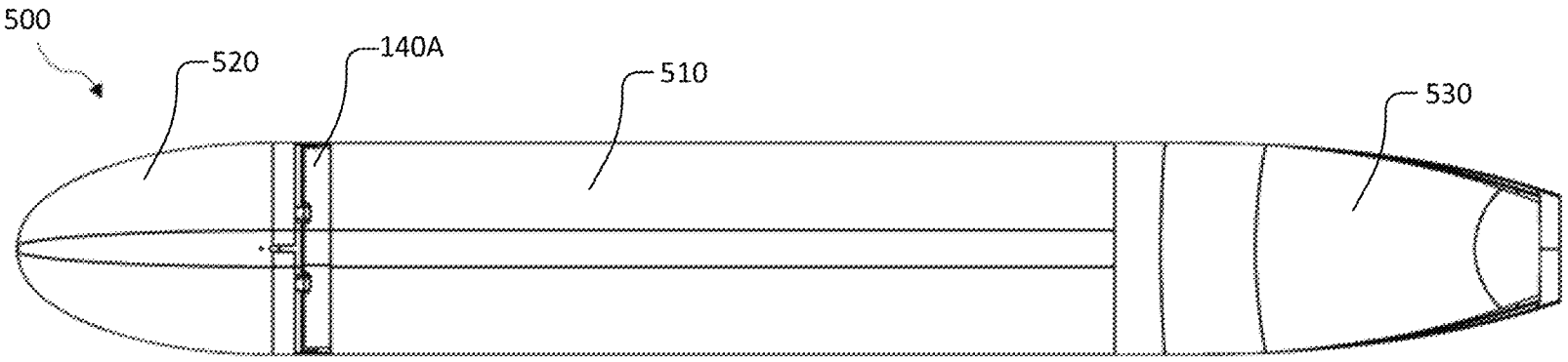
FIG. 7A is a top view of an exemplary unmanned underwater vehicle with a cover, in accordance with one or more embodiments of the present invention(s).
Figure 7B:
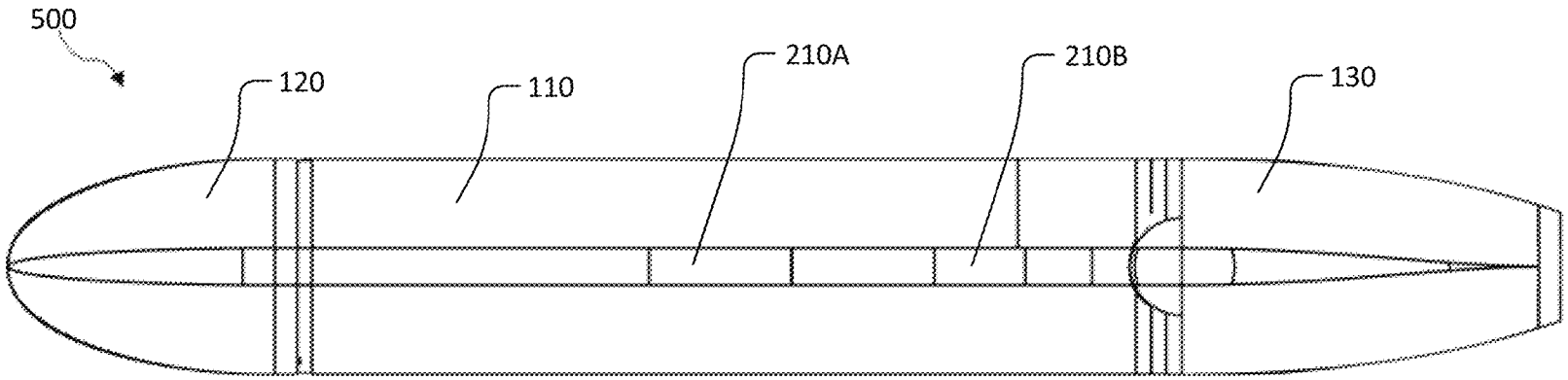
FIG. 7B is a bottom view of an exemplary unmanned underwater vehicle with a cover, in accordance with one or more embodiments of the present invention(s).
Figure 8:
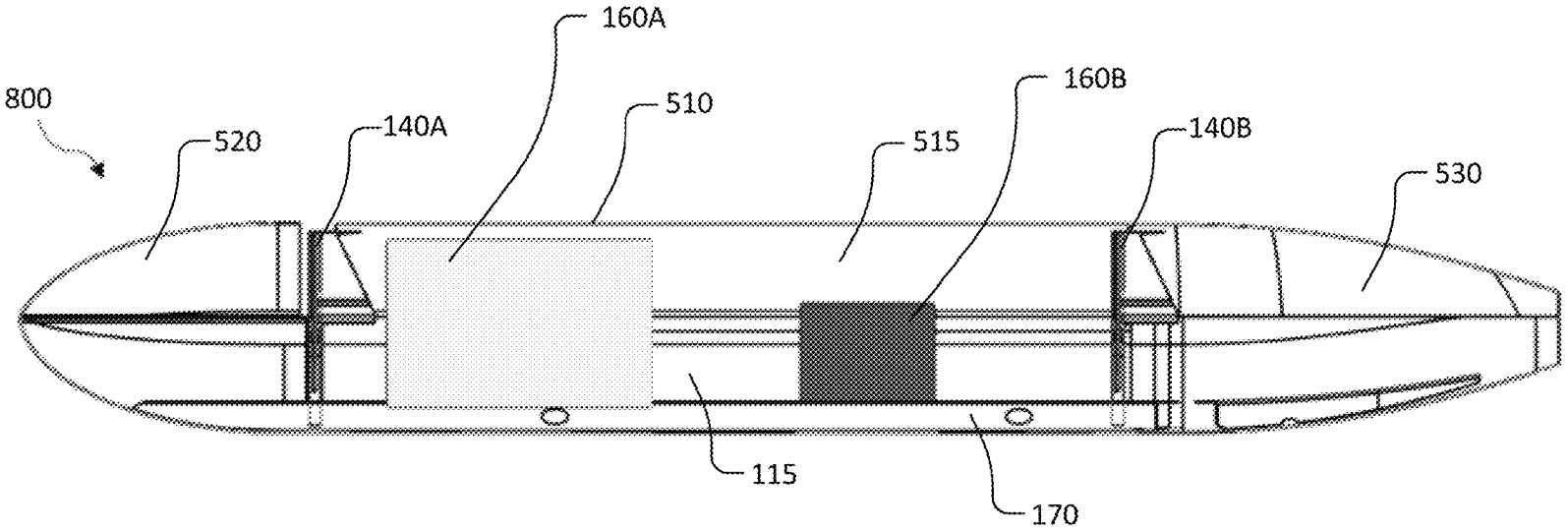
FIG. 8 is a side sectional view of an exemplary unmanned underwater vehicle with a in accordance with one or more embodiments of the present invention(s).

FIGS. 5-8 illustrate an exemplary UUV 500 including a cover 510. The description above with respect to UUVs 100 and 400, generally applies to UUV 500 as well. In some embodiments, cover 510 may include a cover nose portion 520 and a cover tail portion 530. Cover 510 may be placed on and attached to monocoque body 110. Cover nose portion 520 may be placed over nose portion 120 of monocoque body 110. Similarly, cover tail portion 530 may be placed over tail portion 130 of monocoque body 110. Cover 510 can include an outer surface 512 and an inner surface 515 (illustrated in FIG. 8). As illustrated by FIG. 8, which is a side cutaway view of UUV 500, cover 510 may be placed on monocoque body 110 such that inner surface 515 of cover 510 faces inner surface 115 of monocoque body 110, thus forming an interior of UUV 500. Together, outer surface 512 of cover 510 and outer surface 112 of monocoque body 110 can form the outer surface of UUV 500. The interior of UUV 500 may include one or more transverse structural members 140A, 140B, and payloads 160A, 160B, substantially as described above.

Cover 510 can be removably attached to monocoque body 110 in a variety of ways. For example, attachment methods can include, clamps, fasteners (bolts, screws, rivets, etc.), adhesives, or other suitable methods. As another example, an attachment method may include one or more hinges on one side of cover 510 connecting cover 510 to monocoque body 110. The opposite side of cover 510 or monocoque body 110 may then include a lock member to secure cover 510. In some embodiments, UUV 500 may be free-flooding, meaning that cover 510 and monocoque body 110 do not form a watertight seal between one another and water may flow through the interior of UUV 500. In other embodiments, UUV 500 may not be free-flooding and cover 510 and monocoque body 110 may form a seal such that water may not penetrate into the interior of UUV 500.

Cover 510 can be constructed to be lower relative weight as compared to monocoque body 110. Because cover 510 can be non-structural (i.e., a fairing covering the interior of and increasing the hydrodynamics of UUV 500). For example, monocoque body 110 may be about 70% heavier than cover 510. In other embodiments, monocoque body 110 may be heavier than cover 510 by about 50% or more, 55% or more, 60% or more, 65% or more, or 75% or more. Such weight differences can be achieved by varying the construction of cover 510 from that of monocoque underbody 110. For example, cover 510 may be constructed from a lighter weight material. Because cover 510 may not be structural, the material may not need to be as strong as that of monocoque underbody 110. In some embodiments, the material may be the same, but the thickness or total volume of material used to make cover 510 may be less than that used for monocoque underbody 110. As an example, cover 510 may include fewer layers of a fiber-reinforced laminate that monocoque underbody 110. As another example, while monocoque body 110 may include longitudinal supports 170 or other strength-increasing reinforcements that can to provide a strong exoskeleton for the UUV, cover 510 may not incorporate such reinforcements and may thus be lighter.

Figure 6A:
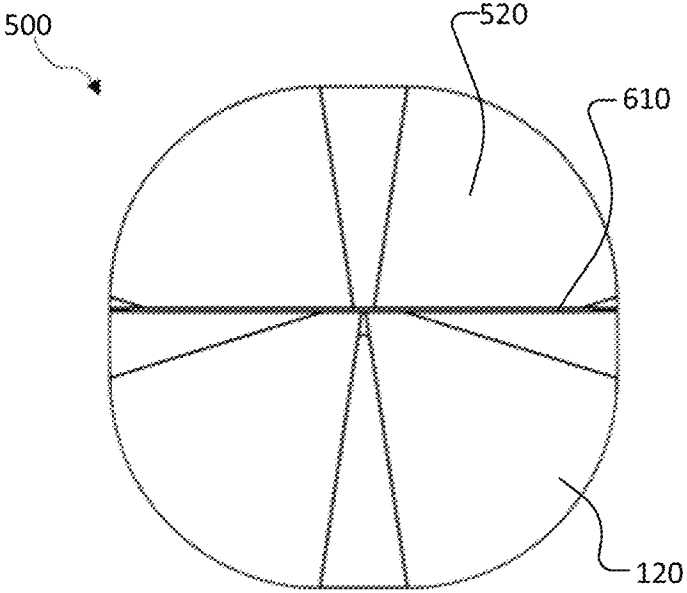
FIG. 6A is a front view of an exemplary unmanned underwater vehicle with a cover, in accordance with one or more embodiments of the present invention(s).

FIG. 6A is a front end view of UUV 500, showing nose portion 120 and cover nose portion 520 meeting at seam 610. As illustrated, seam 610 may be located at a position above the midline of UUV 500. In other words, monocoque body 110 may form greater than 50% of the outer surface of UUV 500 and the cover 510 may form a portion less than 50% of the outer surface. In other embodiments, monocoque body 110 may form about or greater than 30%, about or greater than 35%, about or greater than 40%, about or greater than 45%, about or greater than 55%, about or greater than 60%, about or greater than 65%, about or greater than 70%, or about or greater than 75% of the outer surface of UUV 500.

Similarly, FIG. 6B is an illustration of the back of UUV 500, showing tail portion 120 and cover tail portion 530. Tail portion 120 and cover tail portion 530 can meet at seam 620 on the back of UUV 500. Additionally, tail portion 120 and cover tail portion 530 may form opening 630. Opening 630 may be provided for a propulsion system, such as a propeller, as illustrated by FIG. 9, described in greater detail below.

FIGS. 7A and 7B illustrate a top view and bottom view, respectively of UUV 500. As illustrated in FIG. 7A, in some embodiments, cover 510 may not cover the entire outer surface of UUV 500, for example, an outer edge of transverse structural members 140A can form a portion of the outer surface of UUV 500 by being exposed by cover 510. This may be useful for, for example, lifting and transporting UUV 500. transverse structural members 140A, 140B may include integrated rings, hooks, pins or other attachments (e.g., rings 940A, 940B in FIG. 9) for lifting or otherwise moving UUV 500. Additionally, as described above with respect to UUV 100, UUV 500 can include cutouts 210A, 210B.

Figure 9:
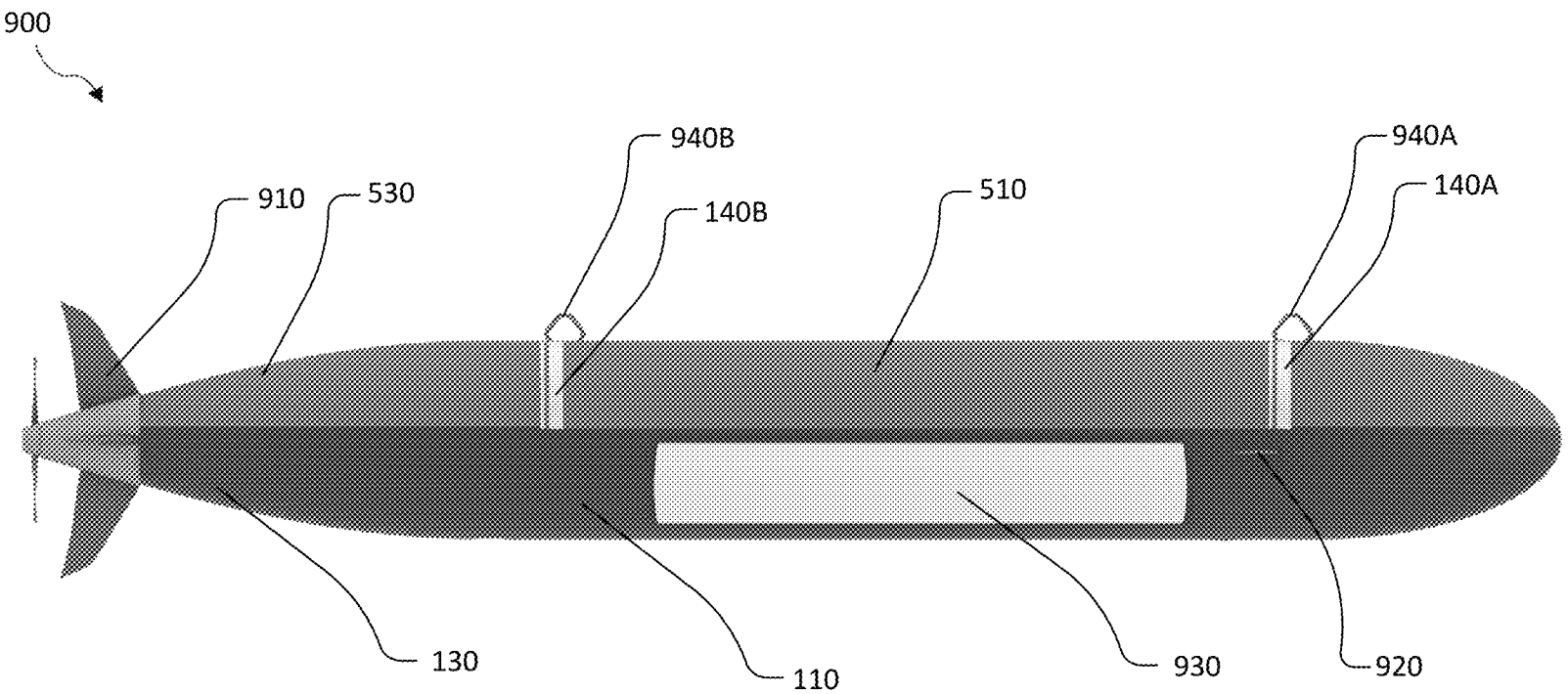
FIG. 9 is a side view of an exemplary unmanned underwater vehicle with a cover and external propulsion system, in accordance with one or more embodiments of the present invention(s).

FIG. 9 is a side view of an exemplary UUV 900 with a cover and external propulsion system, consistent with disclosed embodiments. UUV 900 can include a propulsion system 910. Propulsion system 910 may be disposed in opening 630 (FIG. 6B) between cover 510 (cover tail portion 530) and monocoque body 110 (tail portion 130). As described herein, propulsion system may include a propeller system (as depicted in FIG. 9), a jet system, or others. The propeller system may be driven by, for example, an electric motor contained within UUV 900. UUV 900 may further include one or more fins 920 attached to monocoque body 110 on exterior surface 112. Fins 920 may help control UUV 900 as it travels through the water. In some embodiments, UUV 900 may include a larger cutout 930 (similar to cutouts 210A, 210B described above) than can receive a face of a sensor or other payload to be exposed to the outside surface of the UUV.

Additionally, FIG. 9 depicts exposed transverse structural members 140A, 140B as having rings 940A, 940B, respectively, attached to the top of the dividers. Rings 940A, 940B may take other forms, such as hooks, loops, straps, holes, pins etc. for lifting or otherwise moving UUV 900, or otherwise attaching objects to the outside of UUV 900.

Testing has shown a UUV constructed in accordance with one or more embodiments described herein provides significant performance improvements such with respect to operational range and depth.

For illustrative purposes, the dimensions of the UUV can be in the range of 1' long to 575' long, the major diameter of the monocoque body can be in the range of 1" to 50', and the wall thickness of the monocoque body can be in the range of 1/16" to 5'.

The term "sheet" should be understood to include one or more layers. The layers or material in layer can be adhered together by way of a polymer. For clarification, the term "sheet" also derives from the general techniques for the additive application of carbon fiber construction but should not necessarily be limited to those techniques.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

All references cited and/or discussed in this specification are incorporated herein by reference in their entireties and to the same extent as if each reference was individually incorporated by reference.

What is claimed is:

1. A monocoque body for an unmanned underwater vehicle (UV) comprising:

a nose portion, a tail portion, a body interior surface, a body exterior surface, and wherein the monocoque body comprises an underbody that is a one-piece structural shell made of fiber reinforced sheet, wherein the underbody is configured to receive a removable cover.

2. The monocoque body of claim 1, wherein the fiber reinforced sheet is a polymer reinforced by carbon fiber.

3. The monocoque body of claim 1, wherein the monocoque body forms a portion of a UUV that is free-flooding.

4. The monocoque body of claim 1, further comprising an acoustically transparent window.

5. The monocoque body of claim 4, wherein the acoustically transparent window is integrally formed out of the fiber reinforced sheet and is configured to permit acoustic signals to travel through the monocoque body.

6. The monocoque body of claim 1, wherein:

the body interior surface forms a cavity; and the monocoque body further comprises a plurality of transverse structural members integrally formed into the monocoque body.

7. The monocoque body of claim 6, wherein the transverse structural members separate the cavity into a plurality of payload area(s) configured to receive a payload for attachment to the monocoque body.

8. The monocoque body of claim 7, wherein the payload comprises at least one of: a battery, a motor, a pressure vessel, or a sensor.

9. The monocoque body of claim 1, wherein the monocoque body further comprises one or more longitudinal supports extending axially along the monocoque body between the tail portion and the nose portion.

10. The monocoque body of claim 9, wherein the longitudinal supports form an attachment rail.

11. The monocoque body of claim 10, wherein the attachment rail is configured to removably receive a payload.

12. The monocoque body of claim 1, wherein:

the monocoque body further comprises an aperture extending through the body exterior surface, the aperture being configured to receive a face of a sensor connected to the monocoque body.

13. An unmanned underwater vehicle (UUV) comprising:

a monocoque underbody providing structural support for the UUV and adapted to receive a payload, comprising:

a nose portion, a tail portion, a body interior surface forming a cavity, a body exterior surface, and a plurality of transverse structural members integrally formed into underbody.

14. The UUV of claim 13, wherein the underbody is constructed of a polymer reinforced by carbon fiber.

15. The UUV of claim 13, wherein the UUV is free-flooding.

16. The UUV of claim 13, further comprising:

a cover extending from the nose portion to the tail portion and comprising:

a cover interior surface; and a cover exterior surface;

wherein the cover attaches to the underbody such that the cover interior surface faces the body interior surface, and the cover exterior surface and the body exterior surface together form an exterior surface of the UUV; and wherein the cover is removably attached to permit access to the cavity.

17. The UUV of claim 16, wherein the body exterior surface forms 30% to 70% of a total exterior surface of the UUV.

18. The UUV of claim 16, wherein:

the cover is adapted to have at least one of a lower strength or weight than that of the underbody.

19. The UUV of claim 13, wherein the underbody further comprises one or more longitudinal supports extending axially along the underbody between the tail portion and the nose portion and forming an attachment rail.

* * * * *